US009049517B2

(12) United States Patent
Chick

(10) Patent No.: US 9,049,517 B2
(45) Date of Patent: Jun. 2, 2015

(54) TRANSMISSION LINE LOUDSPEAKER

(71) Applicant: Bose Corporation, Framingham, MA (US)

(72) Inventor: Geoffrey C. Chick, Norfolk, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/022,600

(22) Filed: Sep. 10, 2013

(65) Prior Publication Data

US 2015/0071473 A1 Mar. 12, 2015

(51) Int. Cl.

| | |
|---|---|
| ***H04R 1/20*** | (2006.01) |
| ***H04R 1/28*** | (2006.01) |
| ***H04R 1/30*** | (2006.01) |

(52) U.S. Cl.
CPC .. *H04R 1/20* (2013.01); *H04R 1/28* (2013.01); *H04R 1/2853* (2013.01); *H04R 1/30* (2013.01)

(58) Field of Classification Search
CPC ..... H04R 1/20; H04R 1/28; H04R 1/2853
USPC ..... 381/337, 338, 340; 181/142, 207
See application file for complete search history.

(56) References Cited

U.S. PATENT DOCUMENTS

| | | | | |
|---|---|---|---|---|
| 5,025,885 | A | 6/1991 | Froeschle | |
| 5,092,424 | A | 3/1992 | Schreiber et al. | |
| 5,590,208 | A | 12/1996 | Koyano et al. | |
| 5,659,157 | A | 8/1997 | Shulte | |
| 7,454,030 | B2 | 11/2008 | Graber | |
| 7,886,869 | B2 | 2/2011 | Bastyr et al. | |
| 8,457,341 | B2 | 6/2013 | Danley | |
| 2005/0111673 | A1 | 5/2005 | Rosen et al. | |
| 2009/0087008 | A1 * | 4/2009 | Danley | 381/341 |
| 2010/0206661 | A1 * | 8/2010 | Chan et al. | 181/207 |
| 2011/0026744 | A1 * | 2/2011 | Jankovsky et al. | 381/306 |

FOREIGN PATENT DOCUMENTS

| | | | |
|---|---|---|---|
| EP | 1994793 | A2 | 11/2008 |
| WO | 2007109075 | A2 | 9/2007 |
| WO | 2010136639 | A1 | 12/2010 |

OTHER PUBLICATIONS

International Search Report and Written Opinion dated Nov. 20, 2014 for International Application No. PCT/US2014/054044.

Sergio Canini: "Transflex°", Jul. 16, 2003, XP055152306, Retrieved from the Internet: URL:http://www.caninialtoparlanti.it/subl.htm [retrieved on Nov. 11, 2014] p. 2, last paragraph—p. 3, paragraph first; figure 3.

Anonymous: "speakerplans.com Forum Topic: Horn Sub Junior", Apr. 24, 2007, XP055152291, Retrieved from the Internet: URL:http://forum.speakerplans.com/horn-sub-junior_topic9407.html [retrieved on Nov. 11, 2014] p. 1-p. 2.

* cited by examiner

*Primary Examiner* — Matthew Eason
*Assistant Examiner* — Sean H Nguyen

(57) ABSTRACT

A loudspeaker including an acoustic waveguide includes an enclosure, an acoustic transmission line formed within the enclosure, and a plurality of acoustic transducers contained within the enclosure and disposed along a length of the acoustic transmission line. Each acoustic transducer is configured to emit acoustic energy directly into the acoustic transmission line at two separated locations along the length of the acoustic transmission line.

11 Claims, 13 Drawing Sheets

TRANSMISSION LINE LOUDSPEAKER

BACKGROUND

This invention relates to an acoustic transmission line loudspeaker.

Many conventional loudspeakers utilize waveguides to guide sound pressure waves along a convoluted path within their enclosures. Depending on the characteristics of a given waveguide, a certain portion of the energy present in the sound pressure waves is absorbed while traveling through the waveguide and another portion of the energy passes through the waveguide and is radiated as sound into an external environment. It is often the case that the waveguide is configured such that sound radiated from the waveguide enhances the low frequency output of the loudspeaker.

Some complex conventional loudspeakers include a number of volumes, at least some of which are connected by ports and/or passive radiators. Such loudspeakers include an acoustic transducer which radiates directly into one or two of the volumes. The sound radiated from the transducer propagates through the volumes, through the ports and/or passive radiators, and is eventually radiated into an external environment. The number and size of volumes along with the number, size, and placement of the ports and/or passive radiators are chosen to achieve a desired characteristic in the sound radiated into the external environment.

SUMMARY

In a general aspect, a loudspeaker including an acoustic waveguide includes an enclosure, an acoustic transmission line formed within the enclosure, and a plurality of acoustic transducers contained within the enclosure and disposed along a length of the acoustic transmission line, each acoustic transducer configured to emit acoustic energy directly into the acoustic transmission line at two separated locations along the length of the acoustic transmission line.

Aspects may include one or more of the following features.

The acoustic transmission line may be a folded acoustic transmission line, the enclosure may include an internal wall with each side of the internal wall forming at least some of a boundary of the folded acoustic transmission line, and the plurality of acoustic transducers may be disposed along the internal wall. The internal wall may be corrugated. The internal wall may include a plurality of ridges separated by a plurality of grooves, at least some of the plurality of grooves having one or more of the plurality of acoustic transducers disposed therein.

Each acoustic transducer may be configured to emit a first acoustic energy from a first location of the two separated locations along the length of the acoustic transmission line and to emit a second, complementary acoustic energy from a second location of the two separated locations along the length of the acoustic transmission line. The acoustic transmission line may have a closed end and an open end, the acoustic transmission line tapering from the open end to the closed end. The closed end of the acoustic transmission line may taper to a point.

A cross-sectional diameter of the transmission line at its open end may be greater than a cross-sectional diameter of the transmission line at its closed end. Each acoustic transducer may be a speaker driver. Each speaker driver may include a diaphragm having a front side and a back side, both sides configured to emit acoustic energy into the acoustic transmission line. The enclosure, the acoustic transmission line, and the plurality of acoustic transducers may be configured to generate an acoustic output having a band-pass characteristic. The enclosure, the acoustic transmission line, and the plurality of acoustic transducers may be configured to have two or more impedance minima.

The enclosure, the acoustic transmission line, and the plurality of acoustic transducers are configured to have two or more motion nulls at frequencies in a pass-band of the acoustic output.

Embodiments may include one or more of the following advantages:

Among other advantages, the acoustic transmission line of the loudspeaker reduces high frequency harmonic peaks when compared to conventional loudspeakers due to the closed end of the acoustic transmission line terminating in a point.

The loudspeaker has acoustic transducers mounted on the internal wall such that both sides of the acoustic transducers emit energy into the acoustic transmission line. This reduces high frequency output and improves low frequency output when compared to conventional loudspeakers with acoustic transducers mounted on an external wall.

The loudspeaker has a single outlet and therefore requires no grilles allowing for the placement of objects onto the loudspeaker.

The acoustic transmission line has an inverted taper causing the outlet into the outside environment to be large, resulting in a decrease in the velocity of air leaving the loudspeaker as compared to conventional loudspeakers.

Due to the modifiable shape of the internal wall, the loudspeaker can be configured into a number of different application-specific form factors.

Other features and advantages of the invention are apparent from the following description, and from the claims.

DESCRIPTION

Figure 1:
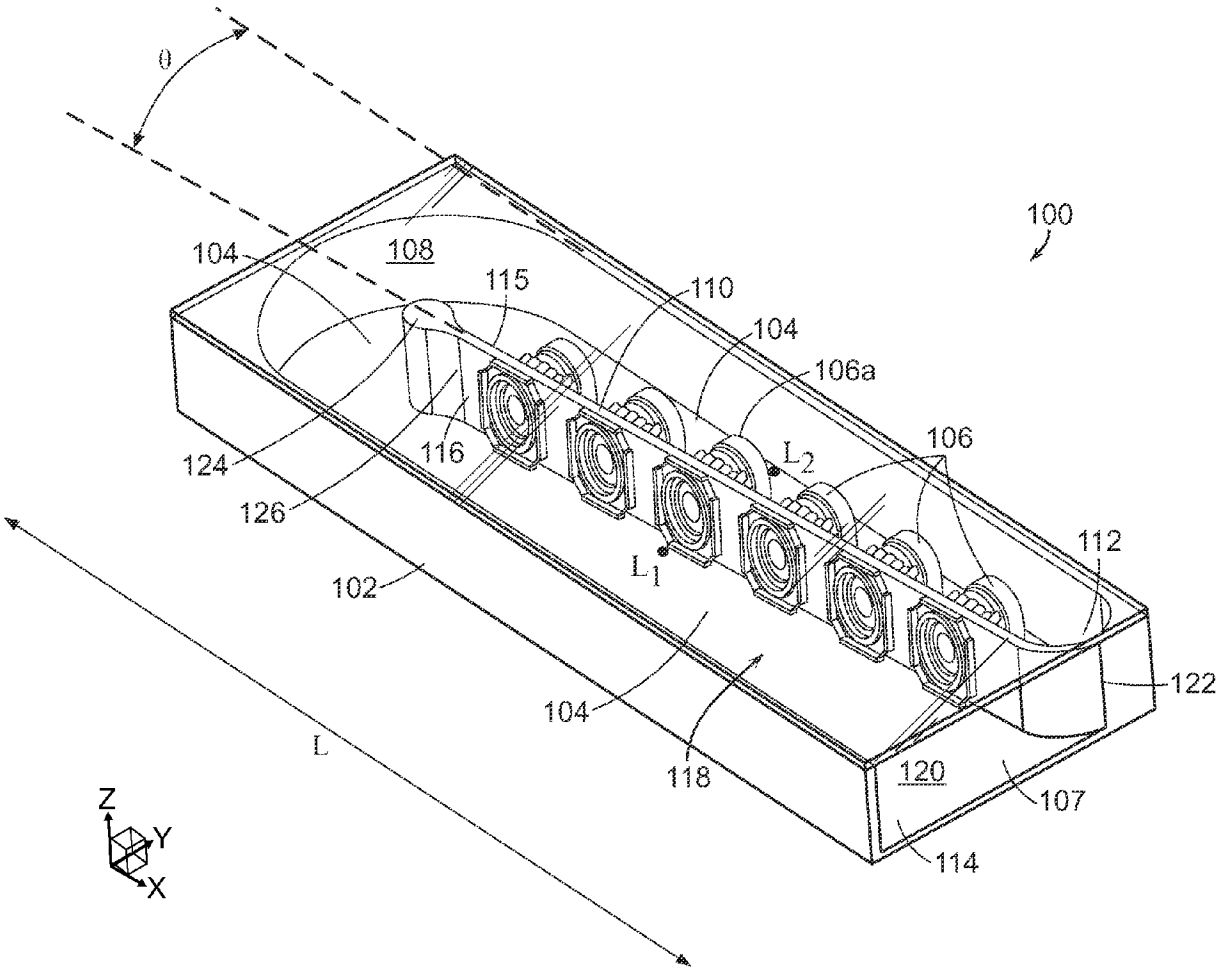
FIG. 1 is a first embodiment of a loudspeaker including an acoustic transmission line.

Referring to FIG. 1, a loudspeaker 100 includes a substantially hollow enclosure 102 including an internal wall 110 and a number of acoustic transducers 106 (i.e., drivers) disposed within the enclosure 102.

1 Enclosure

In some examples, the enclosure 102 includes an opening 107 at a first end 122 of the enclosure 102, a substantially rounded u-shaped inner side surface 108, an inner top surface 118 (shown transparently for the purpose of providing visibility into the enclosure 102 of the loudspeaker 100), and an inner bottom surface 120. The internal wall 110 extends from the inner side surface 108 at a point near or at the first end 122 of the enclosure 102 and partially along a length, L, of the enclosure 102. The internal wall 110 also extends from the inner bottom surface 120 to the inner top surface 118 of the enclosure 102.

2 Acoustic Transmission Line

The inner surface 108 of the enclosure 102 together with the internal wall 110 forms a boundary of an acoustic transmission line 104. The term "acoustic transmission line," as used herein refers to a rigid walled, tubular structure through which sound pressure waves propagate without encountering impediments such as ported walls. In general, an "acoustic transmission line" is long and thin as compared to the wavelength of sound pressure waves present therein. In some examples, a fundamental tuning frequency of the acoustic transmission line is defined by the length of the acoustic transmission line. For example, the modes of a straight waveguide are given by:

$$f_n = \frac{2n-1}{4}\frac{c}{L},$$

where c is the speed of sound and L is the length of the waveguide. Normalizing the modes in terms of c/L gives the frequencies as 0.25, 0.75, 1.25, and so on.

Figure 2:
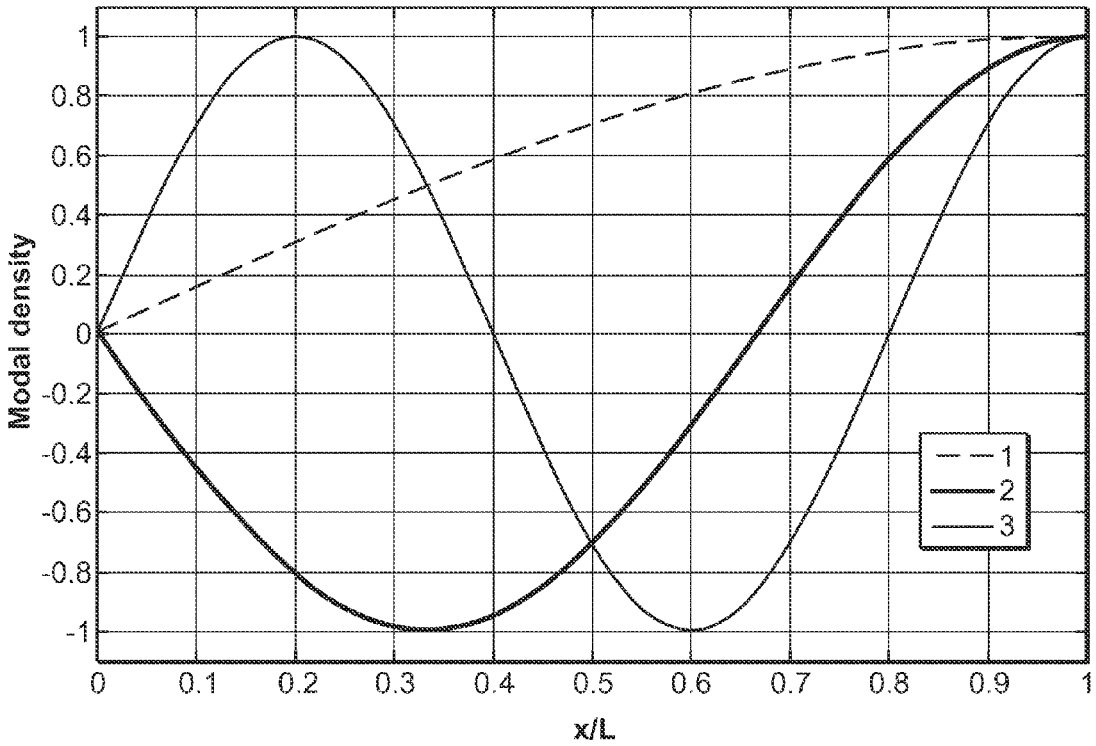
FIG. 2 is a graph of modal density for an acoustic transmission line.

Referring to FIG. 2, the first three modal distribution functions for a straight-walled waveguide of length L are illustrated with the open end on the left. For a waveguide with a length, L, of 2 meters, the frequencies of the modes are 42.4 Hz, 127.3 Hz, and 212.1 Hz.

In the loudspeaker 100 of FIG. 1, the acoustic transmission line 104 is folded in that a first side 115 of the internal wall 110 forms a first part of the boundary of the acoustic transmission line 104 and a second side 116 of the internal wall 110 forms a second, different part of the boundary of the acoustic transmission line 104. That is, the internal wall 110 serves as a shared boundary for at least some of the acoustic transmission line 104.

The acoustic transmission line 104 has a first end 112 which is closed to an outside environment 116 and a second end 114 which opens to the outside environment 116 through the opening 107 in the enclosure 102. In operation, acoustic energy present in the transmission line propagates from the first end 112 to the second end 114 and into the outside environment 116 through the opening 107.

Figure 3:
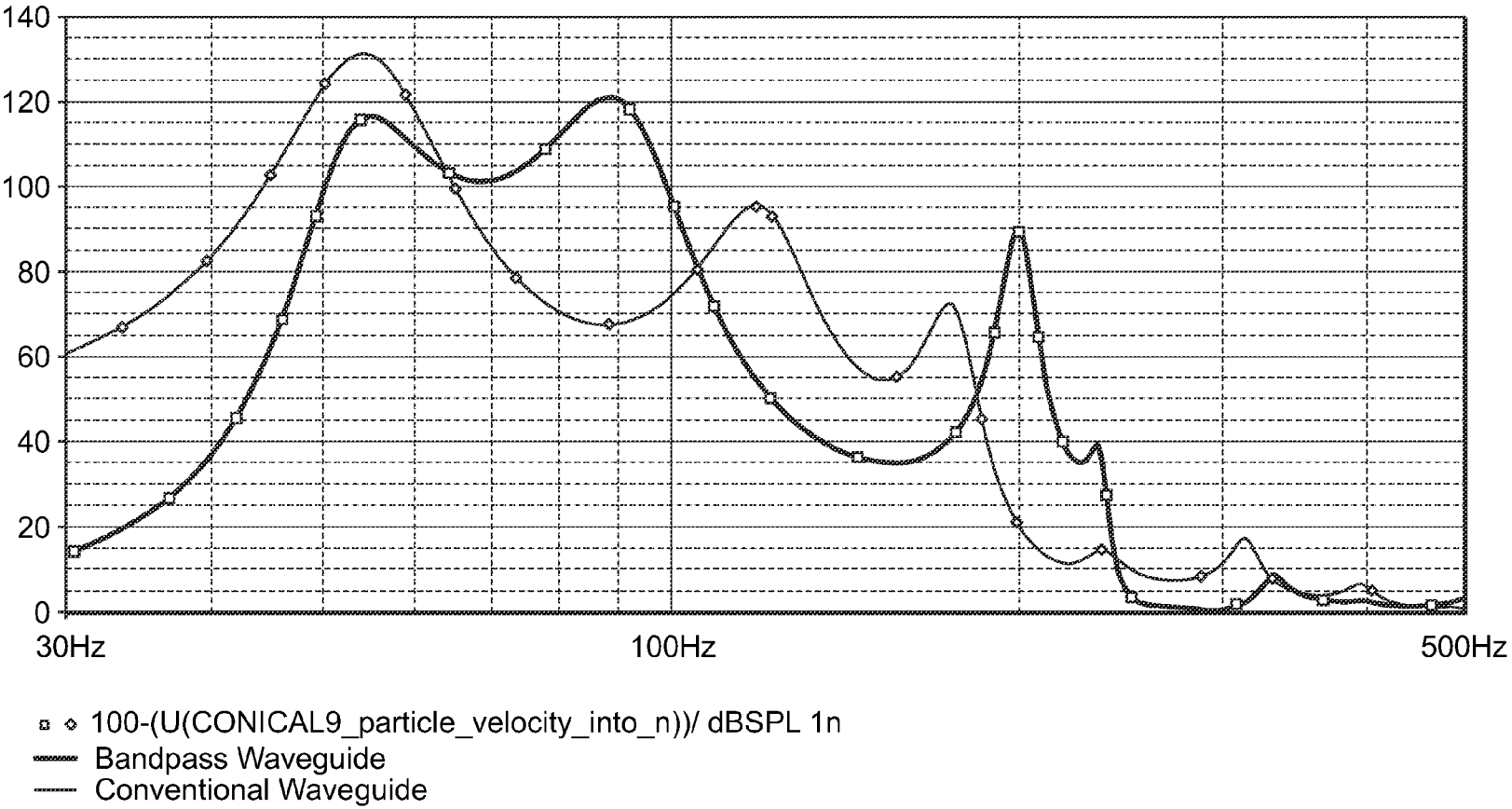
FIG. 3 is a graph of port velocity vs. frequency for a conventional and a band-pass acoustic transmission line.

In some examples, the internal wall 110 extends in a direction along the length, L, of the enclosure 102 at an angle, θ relative to the inner side surface 108. By extending at the angle, θ, the acoustic transmission line 104 is tapered such that a cross sectional area of the acoustic transmission line 104 at its first end 112 is smaller than a cross sectional area of the acoustic transmission line 104 at its second end 114. In some examples, this type of taper is referred to as an "inverted taper." In some examples, the taper of the acoustic transmission line 104 reduces a velocity and turbulence of the air exiting the acoustic transmission line 104 thereby reducing unwanted nose. In some examples it is desirable to maintain the velocity of air exiting the port at less than 15 m/s. Referring to FIG. 3, a plot of port velocity vs. frequency for a conventional waveguide (shown in green) and a band-pass waveguide (shown in red) illustrates a reduced port velocity for the band-pass waveguide at a number of frequencies.

In some examples, the angle, θ is adjusted to optimize the reduction in noise and to suppress the propagation of unwanted high frequency harmonic peaks. In some examples, the first end 112 of the acoustic transmission line 104 tapers to a point.

In some examples, a rounded (e.g., teardrop shaped) member 124 is disposed at a detached end 126 of the internal wall 110 for the purpose of facilitating the flow of air around the detached end 126 of the internal wall 110. In some examples, the rounded member 124 reduces turbulence in the air as the air propagates past the detached end 126 of the internal wall 110. In some examples a size of the teardrop shaped member 124 is made substantially large relative to the cross-section of the acoustic transmission line 104 in order to increase the path length of the acoustic transmission line 104, thereby reducing the tuning frequency of the acoustic transmission line 104.

In some examples, the output characteristic of the loudspeaker 100 can be varied by altering the physical characteristics of the acoustic transmission line 104. For example, a loudspeaker designer may vary the length of the acoustic transmission line 104, the angle, θ of taper of the acoustic transmission line 104, the total volume of the acoustic transmission line 104, the overall size of the enclosure 102, the size of the opening 107 in the enclosure 102, the length of the internal wall 110, and so on.

In some examples, acoustically absorbent material (e.g., foam) is placed in the acoustic transmission line 104 (e.g., at the closed end 112 of the acoustic transmission line 104) to attenuate harmonic peaks.

1 Acoustic Transducers

In some examples, the acoustic transducers 106 are conventional loudspeaker drivers, each having a diaphragm (e.g., a cone) which moves back and forth to generate pressure waves in the air in front of and behind the diaphragm. The acoustic transducers 106 are disposed through the internal wall 110 and therefore along a length of the acoustic transmission line 104. Due to this arrangement, each transducer 106 is positioned and completely contained within the acoustic waveguide 104 such that the transducer emits acoustic pressure waves in a direction substantially perpendicular to the internal wall 110 and directly into the acoustic transmission line 104 at two separated locations along the length of the acoustic transmission line 104.

For example, focusing on a single acoustic transducer 106*a*, the acoustic transducer 106*a* is disposed through the internal wall 110 such that a front side of the acoustic transducer's diaphragm faces into the acoustic transmission line 104 at a first location, $L_1$, and a back side of the acoustic transducer's diaphragm faces into the acoustic transmission line 104 at a second location, $L_2$, which is separated from $L_1$ along the length of the acoustic transmission line 140.

When an electrical signal is applied to the acoustic transducer 106*a*, the diaphragm of the acoustic transducer moves back and forth. Due to the movement of the diaphragm, the acoustic transducer 106*a* emits acoustic pressure waves from the front of the diaphragm directly into the acoustic transmission line 104 at location $L_1$. The acoustic transducer 106*a* also emits acoustic pressure waves from the back side of the diaphragm directly into the acoustic transmission line 104 at location $L_2$.

In some examples, the acoustic transducers 106 are equally spaced. In other examples, the acoustic transducers 106 are unequally spaced to obtain a desired output characteristic (e.g., to reduce harmonic peaks at high frequencies).

In some examples, the number of acoustic transducers 106 can be increased or decreased, resulting in a corresponding increase or decrease in the total amount of diaphragm area present in the loudspeaker 100. Increasing or decreasing the total amount of diaphragm area causes a corresponding increase or decrease in an output power of the loudspeaker 100. In some examples, having a larger number of acoustic transducers 106 present in the loudspeaker 100 may result in better high frequency performance for the loudspeaker 100 due to an increased cone area which causes a spreading or randomization in the propagation of high frequency harmonic peaks as opposed to acting at a single narrow point. Alternately, a similar effect may be achieved by using fewer acoustic transducers, each with wider (e.g., oblong) cones that also spread out or randomize the propagation of high frequency harmonic peaks. In some examples, a single acoustic transducer with a cone spanning the internal wall 110 may be used.

2 Operation

In operation, an electrical signal is applied to one or more of the acoustic transducers causing the diaphragms of the one or more acoustic transducers to move back and forth. Due to the movement of the diaphragms, the acoustic transducers 106 emit acoustic pressure waves from both the front and back sides of their respective diaphragms directly into the acoustic transmission line 104.

In some examples, the same electrical signal is provided to each of the acoustic transducers 106, causing the acoustic transducers 106 to generate sound pressure waves in phase with one another.

In a simple example, when a sinusoidal electrical signal of sufficiently low frequency is provided in phase to each of the acoustic transducers 106, the back sides of the diaphragms of the acoustic transducers 106 move toward the back sides of the acoustic transducers 106 causing an increase in acoustic pressure in the portion of the acoustic transmission 104 line behind the acoustic transducers 106. Due to the shape of the acoustic transmission line 104, the acoustic pressure generated behind the acoustic transducers 106 propagates through the acoustic transmission line 104, in a direction from the first end 112 of the acoustic transmission line 104 to the second end 114 of the acoustic transmission line 107.

Figure 4:
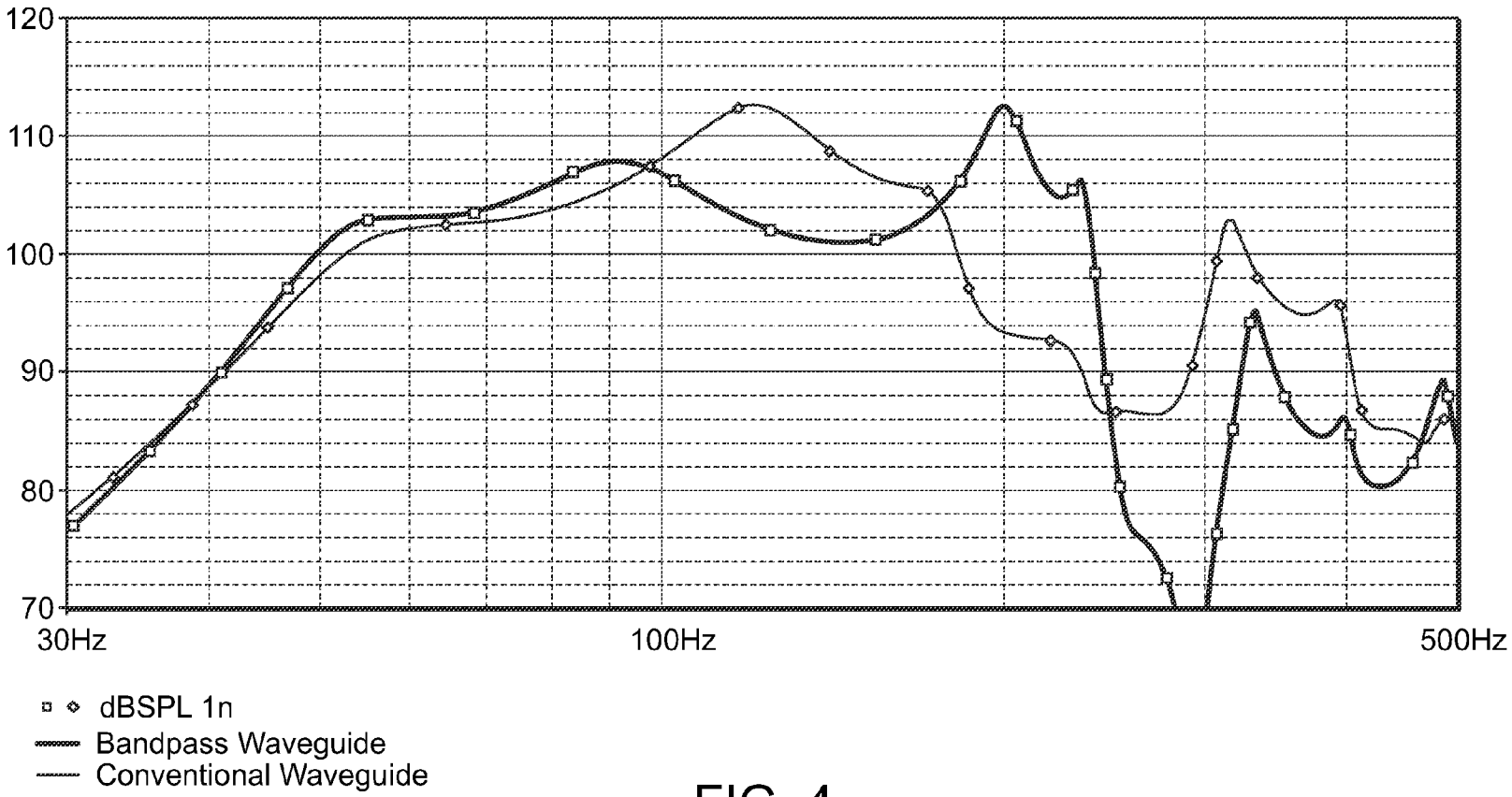
FIG. 4 is a graph of acoustic output vs. frequency for a conventional and a band-pass acoustic transmission line.

As the acoustic pressure propagates into the portion of the acoustic transmission line 104 in front of the acoustic transducers 106, the front sides of the diaphragms of the acoustic transducers 106 move toward the front of the acoustic transducers 106, causing an additional increase in acoustic pressure (i.e., by constructive interference) in the portion of the acoustic transmission line 104 in front of the acoustic transducers 106. In this way, the output of the loudspeaker 100 is boosted at certain frequencies by combining the acoustic pressure generated at the back sides of the acoustic transducers 106 with the acoustic pressure generated at the front sides of the acoustic transducers 106. The combined acoustic pressure propagates to the outside environment 116 through the second end 114 of the acoustic transmission line 104 at the opening 107 in the enclosure 102. Referring to FIG. 4, a plot of system output vs. frequency for a conventional acoustic transmission line (shown in red) and a band-pass waveguide (shown in green) illustrates a boost in output in a frequency range between 45 Hz and 95 Hz and at approximately 200 Hz.

In other examples, the phase of the electrical signal applied to the acoustic transducers 106 is varied to alter the characteristics of the sound pressure waves emitted into the outside environment 116. In some examples, the phase of the electrical signal applied to the acoustic transducer 106 near the closed end 112 of the acoustic transmission line 104 is varied to alter frequency characteristics in a narrow frequency range around the fundamental tuning frequency of the acoustic transmission line 104.

In yet other examples, different electrical signals are applied to each of the acoustic transducers 106 (or to subsets of the acoustic transducers 106) to alter the characteristics of the sound pressure waves emitted into the outside environment 116. For example, one or more acoustic transducers 106 near the closed end 112 of the acoustic transmission line 104 may be supplied with a higher voltage (causing a greater cone excursion) than the other acoustic transducers 106 successively spaced along wall 110. In some examples, doing so has the same acoustic effect as if the inner wall 110 were pivoted at the teardrop shaped member 124 and the portion of the inner wall 110 near the closed end 112 of the acoustic transmission line 104 moved back and forth to generate pressure in the in the acoustic transmission line 104.

Figure 5:
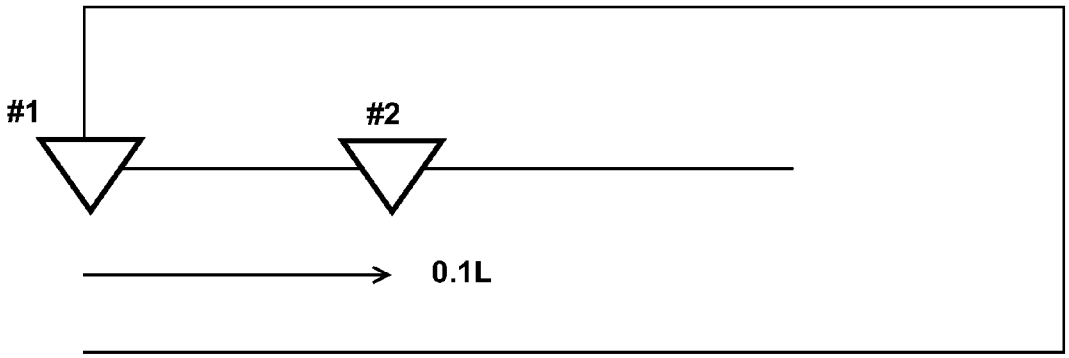
FIG. 5 is a simple example of acoustic transducer placement within an acoustic transmission line.

Referring to FIG. 5, a simple example of an acoustic transmission line illustrates the effects of acoustic transducer placement and acoustic transmission line length. The acoustic transmission line includes two acoustic transducers #1, and #2. Transducer #1 is disposed at the closed end of the acoustic transmission line and acoustic transducer #2 is disposed at $1/10^{th}$ the length of the acoustic transmission line.

Figure 6:
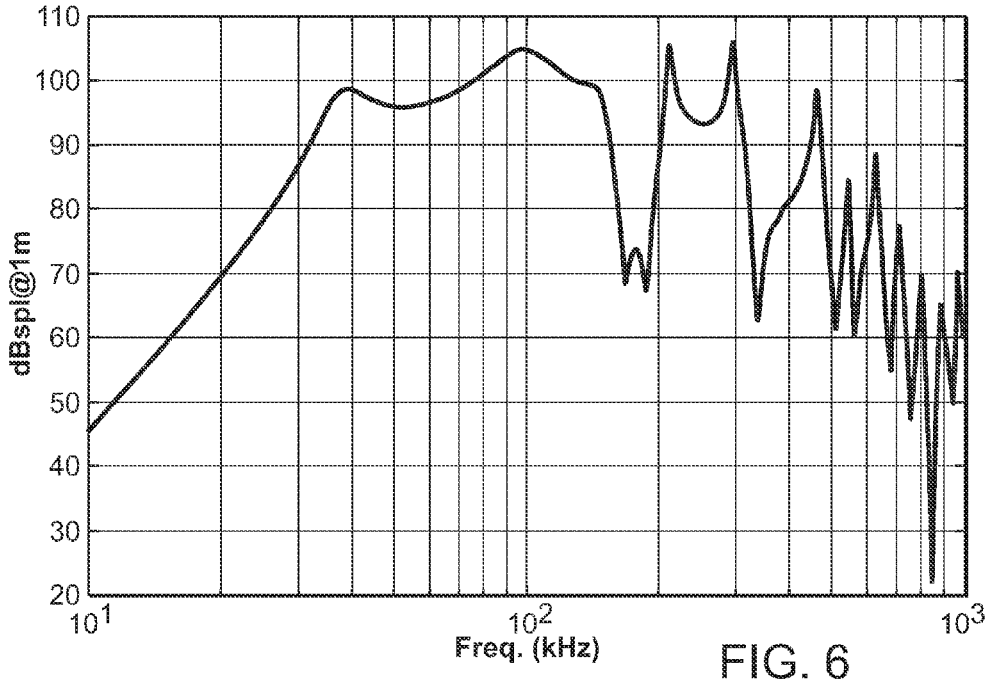
FIG. 6 is a graph of acoustic output vs. frequency for the acoustic transmission line of FIG. 5.
Figure 7:
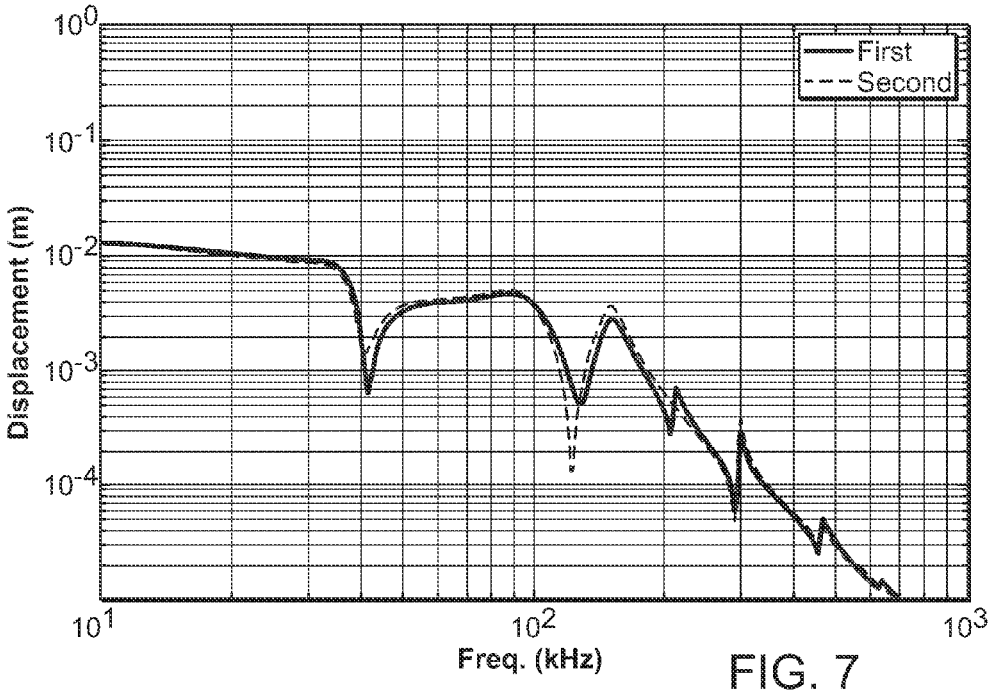
FIG. 7 is a graph of acoustic transducer displacement vs. frequency for the acoustic transducers of FIG. 5.

Referring to FIGS. 6 and 7, the system output vs. frequency as measured at 1 m from the opening of the acoustic transmission line of FIG. 5 and the acoustic transducer displacement vs. frequency of the two acoustic transducers of FIG. 5 are illustrated, respectively.

Figure 8:
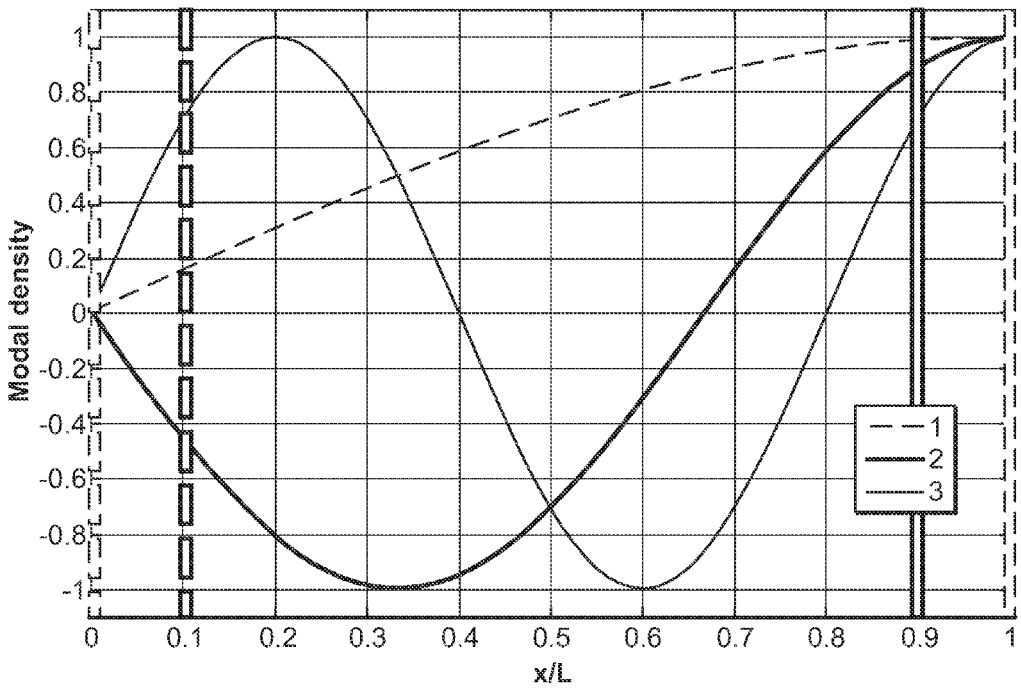
FIG. 8 is a graph illustrating pressure load on the acoustic transducers of FIG. 5 at different positions in the modal distribution.

Referring to FIG. 8, the pressure load from the modes of the waveguide on the two acoustic transducers of FIG. 5 is illustrated along with the positions of the acoustic transducers in the modal distribution. In FIG. 8, the first acoustic transducer is sketched in blue with the front of the driver a solid line and the back a dashed line, similarly, the second acoustic transducer's position is shown in green.

It can be seen that at the first mode (shown in blue) the first acoustic transducer has high pressure on the front and little to no pressure on the back; the mode loads the acoustic transducer heavily at this frequency and reduces the displacement as seen at around 41 Hz in the acoustic transducer displacement plot of FIG. 7. The second acoustic transducer is in a similar situation, with high pressure (but slightly lower than the first acoustic transducer) on the front and low pressure (but above zero) on the back, so, again, the mode loads the acoustic transducer and reduces displacement. The effect is smaller than on the first acoustic transducer because the pressure change is smaller—this can be seen in the displacement plot of FIG. 7.

For the second mode (shown in green), the first acoustic transducer is again at high pressure on the front and low pressure on the back. The second acoustic transducer is at high pressure on the front and negative pressure on the back. The second mode very heavily loads the second acoustic transducer so the acoustic transducer displacement goes down significantly, as seen in the displacement plot of FIG. 7.

Finally, for the third mode (shown in red), the first acoustic transducer is at high pressure on the front and zero pressure on the back. The second acoustic transducer, however, is at high pressure on the both the front and the back so this mode doesn't load this acoustic transducer and the displacement is unaffected in the displacement plot of FIG. 7.

3 Experimental Results

Figure 9:
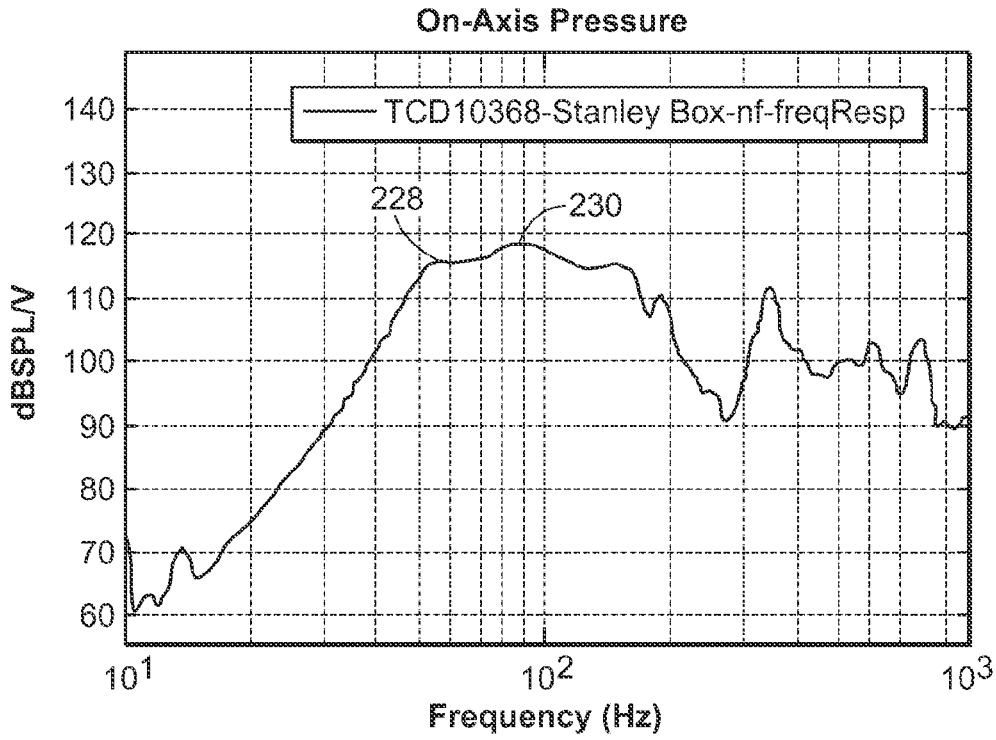
FIG. 9 is a graph of on-axis pressure produced by a loudspeaker including an acoustic transmission line vs. frequency.

Referring to FIG. 9, a graph of on-axis acoustic pressure vs. frequency is presented for one exemplary configuration of the loudspeaker 100 of FIG. 1. The example loudspeaker 100 used to generate the data shown in the graph has an acoustic transmission line 104 with a length of 2 m, a 4° angle of taper, and an opening 107 with an area of $7E^{-3}$ $m^2$.

Due to the above-described physical characteristics of the loudspeaker 100, the graph of on-axis pressure vs. frequency includes a first "fundamental" resonant peak 228 at approximately 52 Hz and a second resonant peak 230 at approximately 95 Hz. The second resonant peak 230 is the first harmonic of the fundamental resonant peak 228 occurring at 52 Hz. In some examples, internal turbulence and absorbent material can alter the frequency of the second resonant peak 230.

Together, the two resonant peaks, which are closely grouped in frequency, result in a band-pass effect in the output of the loudspeaker 100 by boosting the output in the frequency range of 52 Hz-156 Hz and attenuating the output at frequencies above approximately 180 Hz.

Figure 10:
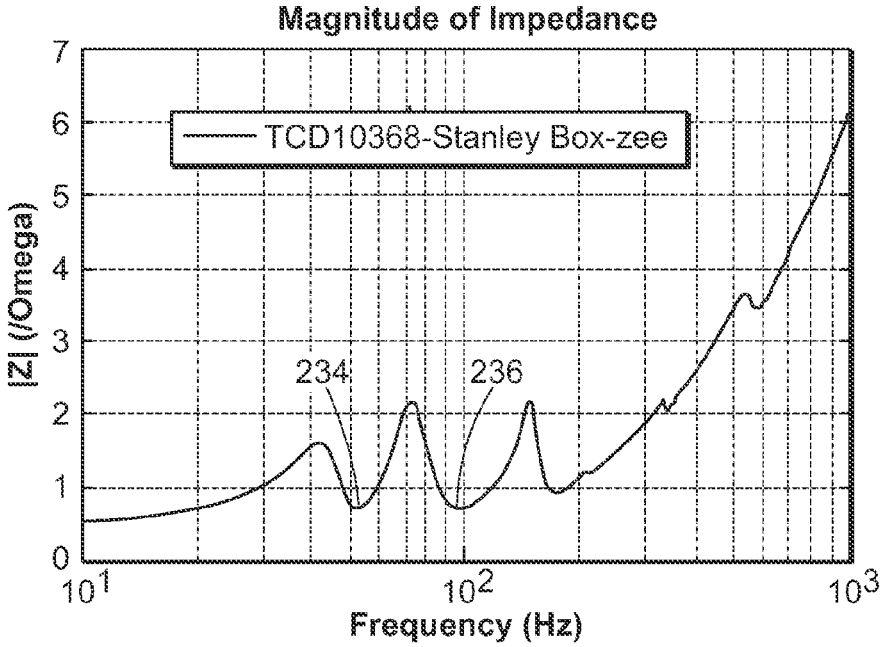
FIG. 10 is a graph of the magnitude of the impedance of a loudspeaker including an acoustic transmission line vs. frequency.

Referring to FIG. 10, a graph of the magnitude of the output impedance of the example loudspeaker 100 described above includes a first impedance minimum 234 (indicating that a motion null near is nearby in frequency) at approximately 52 Hz and a second impedance minimum 236 at approximately 95 Hz.

When viewing FIG. 10 in light of FIG. 9, it becomes apparent that the two impedance minima 234, 236 in FIG. 10 are, as expected, approximately frequency aligned with the two resonant peaks 228, 230 of FIG. 9.

In some examples of closed ended acoustic transmission lines, a first motion null or impedance minimum occurs when the length of the waveguide is equal to $\frac{1}{4}\lambda$, where $\lambda$ is the wavelength of the frequency being reproduced. A second motion null occurs when the length of the acoustic transmission line is equal to $\frac{3}{4}\lambda$, and a third motion null occurs at $5/4\lambda$, and so on.

4 Alternative Embodiments

Figure 11:
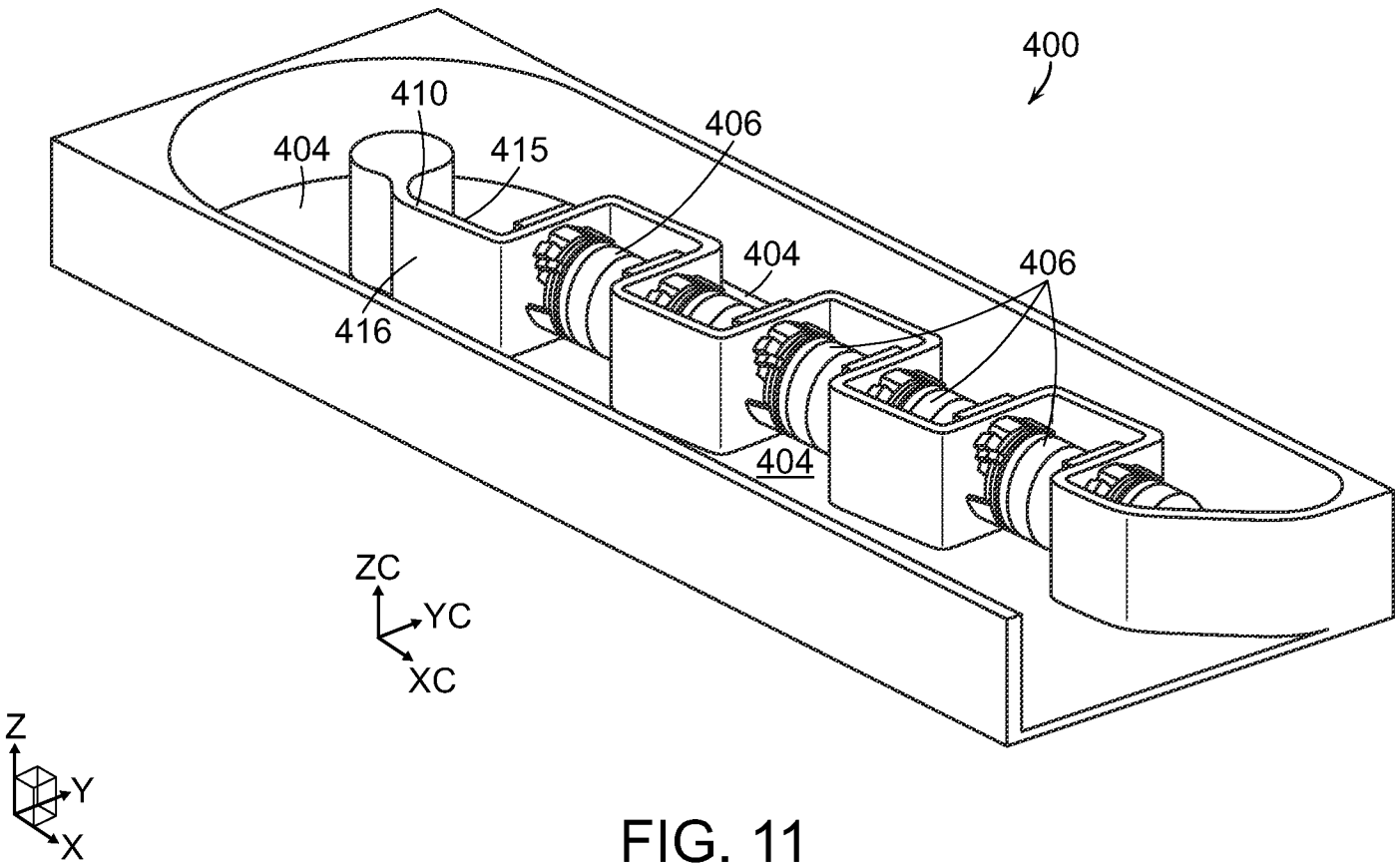
FIG. 11 is a second embodiment of a loudspeaker including an acoustic transmission line.

Referring to FIG. 11, another example of a loudspeaker 400 is similar to the loudspeaker 100 of FIG. 1 with the exception that the loudspeaker 400 has a corrugated internal wall 410 and a non-tapering acoustic transmission line 404.

Owing to the corrugated shape of the internal wall 410, acoustic transducers 406 can be installed in the internal wall 410 with an alternating direction of installation. That is, at least some of the acoustic transducers 406 are installed with their front sides facing outward from a first side 415 of the internal wall 410 and the remaining acoustic transducers 406 are installed with their front sides facing outward from a second, opposite side 416 of the internal wall 410. In some examples, the alternating direction of installation of the transducer 406 reduces harmonic distortion due to a change in cone area that results from the cone travelling inward and outward in the acoustic transducer.

Furthermore, the corrugated wall allows for the acoustic transducers 406 to be disposed through the internal wall 410 such that they emit acoustic pressure waves in a direction substantially parallel to a direction of extension of the internal wall 410 and directly into an acoustic transmission line 404 at two separated locations along the length of the acoustic transmission line 404.

The above-described arrangement of the acoustic transducers 406 in the corrugated internal wall 410 acts to reduce or cancel unwanted vibrations in the internal wall 410. The corrugated internal wall 410 can also permit use of a reduced length acoustic transmission line 404 while maintaining the same number of acoustic transducers 406 (e.g., to reduce the overall size of the loudspeaker 400) or to increase the number of acoustic transducers 406 while maintaining the length of the acoustic transmission line (e.g., to increase the output power of the loudspeaker 400).

Figure 12:
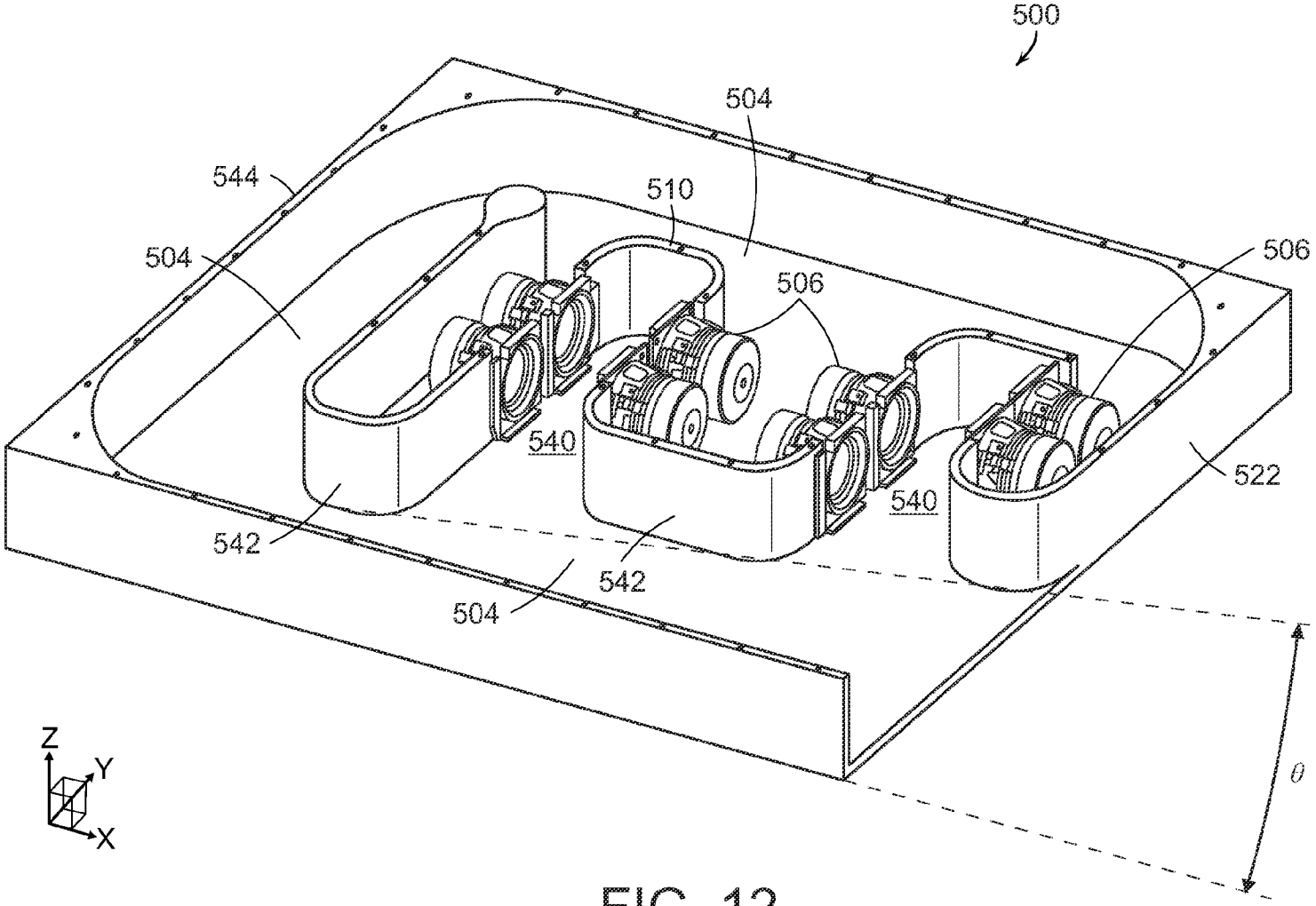
FIG. 12 is a third embodiment of a loudspeaker including an acoustic transmission line.

Referring to FIG. 12, another example of a loudspeaker 500 is similar to the loudspeaker 100 of FIG. 1 with the exception that internal wall 510 of the loudspeaker 500 is corrugated (having corrugation grooves 540 and corrugation ridges 542) and is tapered.

Due to the corrugated shape of the internal wall 510 of the loudspeaker 500, acoustic transducers 506 included in the loudspeaker 500 are disposed through the internal wall 510 such that they emit acoustic pressure waves in a direction substantially parallel to a direction of extension of the internal 510 and directly into an acoustic transmission line 504 at two separated locations along the length of the acoustic transmission line 504.

Furthermore, the acoustic transducers 506 are installed in the internal wall 510 such that the front sides of the acoustic transducers 506 facing into a given corrugation groove 540 face one another and the back sides of the acoustic transducers 506 facing into another, different corrugation groove 540 face one another.

The above-described arrangement of the acoustic transducers 506 in the corrugated internal wall 510 acts to reduce or cancel unwanted vibrations in the internal wall 510. The corrugated internal wall 510 can also permit use of a reduced length acoustic transmission line 504 while maintaining the same number of acoustic transducers 506 (e.g., to reduce the overall size of the loudspeaker 500 or to change the form factor of the loudspeaker 500) or to increase the number of acoustic transducers 506 while maintaining the length of the acoustic transmission line (e.g., to increase the output power of the loudspeaker 500).

In some examples, the corrugation grooves 540 of the corrugated internal wall 510 increase in depth as the corrugated internal wall 510 extends from a front side 522 of the enclosure 502 of the loudspeaker 500 to a back side 544 of the enclosure 502. This increase in corrugation groove depth causes at least some of the acoustic transmission line 504 to taper at an angle, $\theta$. The taper in the acoustic transmission line 504 provides the similar benefits as the taper in the acoustic transmission line 104 of FIG. 1.

Referring to FIGS. 6-11, a number of alternative loudspeaker configurations include multiple drivers disposed in various configurations within acoustic transmission lines of various shapes and sizes.

Figure 13:
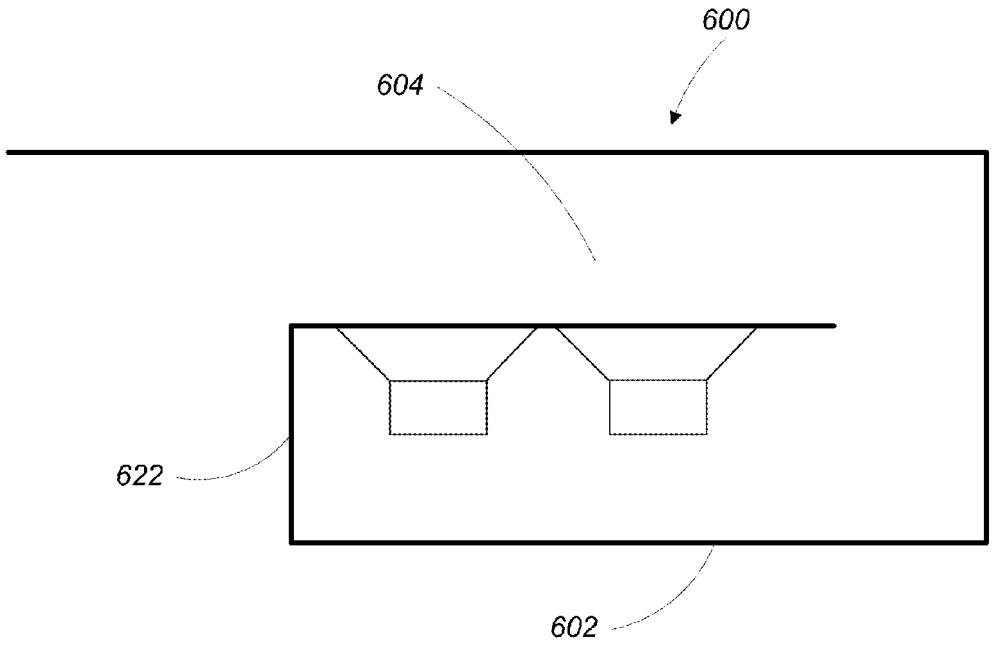
FIG. 13 is a fourth embodiment of a loudspeaker including an acoustic transmission line.
Figure 14:
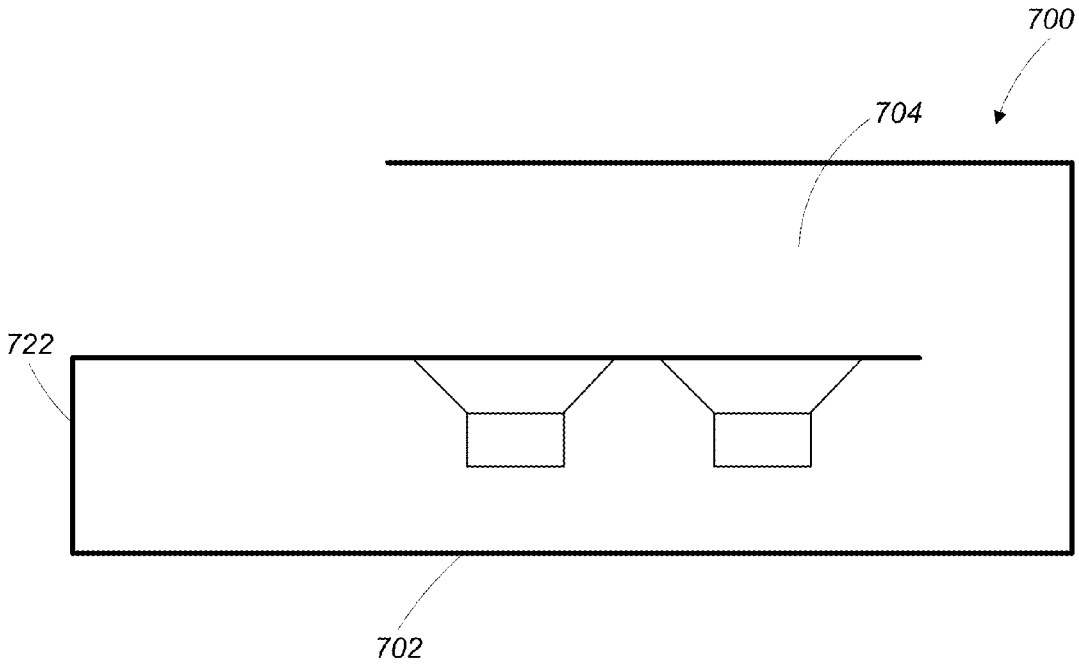
FIG. 14 is a fifth embodiment of a loudspeaker including an acoustic transmission line.
Figure 15:
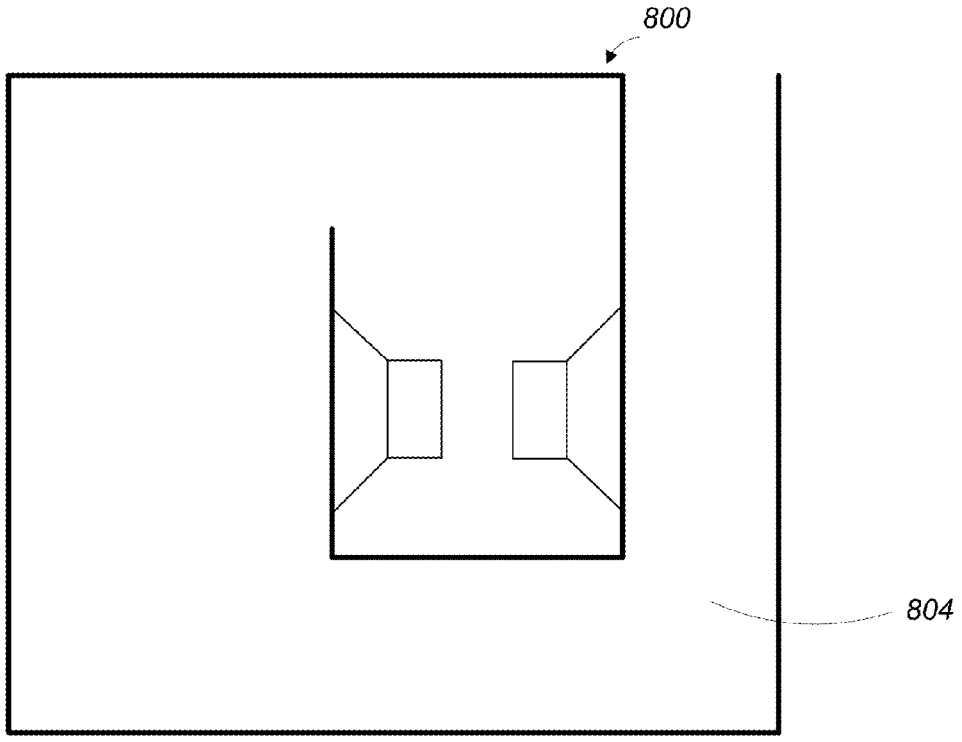
FIG. 15 is a sixth embodiment of a loudspeaker including an acoustic transmission line.
Figure 16:
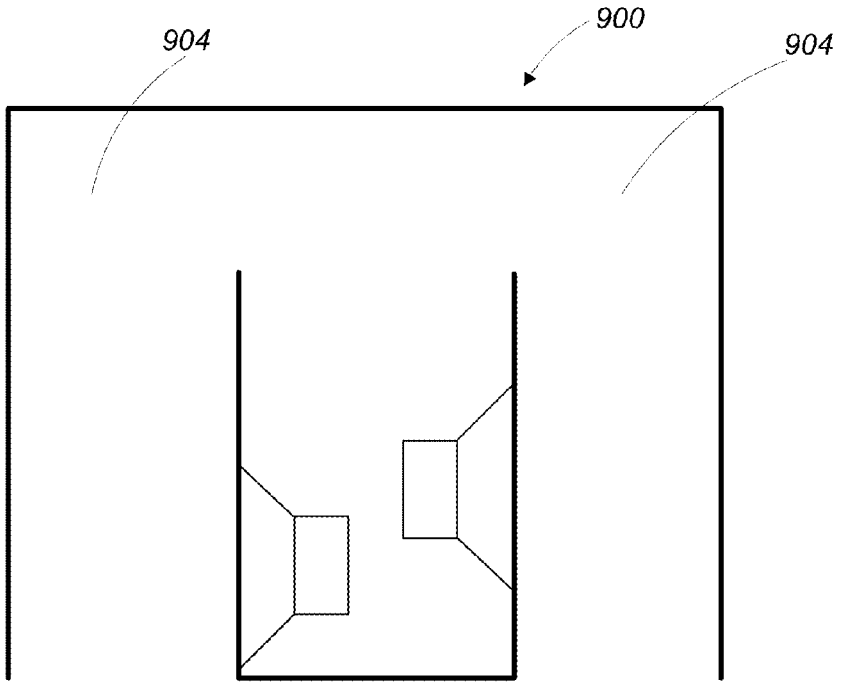
FIG. 16 is a seventh embodiment of a loudspeaker including an acoustic transmission line.
Figure 17:
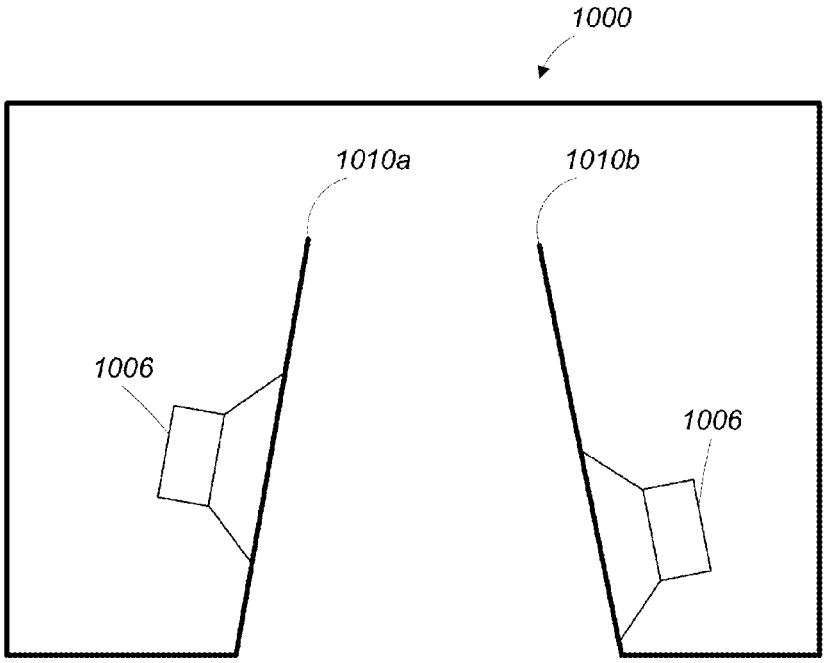
FIG. 17 is an eighth embodiment of a loudspeaker including an acoustic transmission line.
Figure 18:
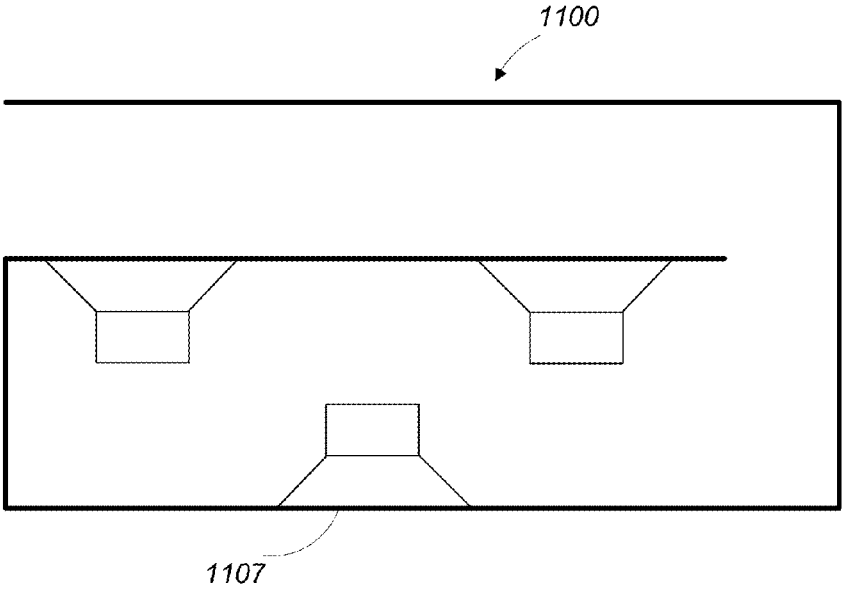
FIG. 18 is a ninth embodiment of a loudspeaker including an acoustic transmission line.

Referring to FIG. 13, one alternative loudspeaker configuration 600 has an acoustic transmission line 604 extending past a first end 622 of an enclosure 602. Referring to FIG. 14, another alternative loudspeaker configuration 700 has an acoustic transmission line 704 which does not extend all the way to a first end 722 of an enclosure 702. Referring to FIG. 15, another alternative loudspeaker configuration 800 has a lengthened and substantially spiraling acoustic transmission line 804. Referring to FIG. 16, another alternative loudspeaker configuration 900 has a bifurcated acoustic transmission line 904. Referring to FIG. 17, another alternative loudspeaker configuration 1000 has two internal walls 1010*a*, 1010*b*, each having an acoustic transducer 1006 disposed therein. Referring to FIG. 18, another alternative "hybrid" loudspeaker configuration 1100 has one of its acoustic transducers 1107 emitting directly into an outside environment 1116.

It is to be understood that the foregoing description is intended to illustrate and not to limit the scope of the invention, which is defined by the scope of the appended claims. Other embodiments are within the scope of the following claims.

What is claimed is:

1. A loudspeaker comprising an acoustic waveguide comprising:

an enclosure;

an acoustic transmission line formed within the enclosure; and a plurality of acoustic transducers contained within the enclosure and disposed along a length of the acoustic transmission line, each acoustic transducer configured to emit acoustic energy directly into the acoustic transmission line at two separated locations along the length of the acoustic transmission line, wherein the acoustic transmission line is a folded acoustic transmission line, the enclosure includes an internal wall with each side of the internal wall forming at least some of a boundary of the folded acoustic transmission line, and the plurality of acoustic transducers are disposed along the internal wall, wherein the internal wall is corrugated, wherein the plurality of acoustic transducers are disposed through the internal wall such that they emit acoustic pressure waves in a direction substantially parallel to a direction of extension of the internal wall, and wherein the plurality of acoustic transducers are installed in the internal wall such that the front sides of the acoustic transducers facing into a first corrugation groove face one another and the back sides of the of the acoustic transducers facing into a second corrugation groove face one another.

2. The loudspeaker of claim 1 wherein the internal wall includes a plurality of ridges separated by a plurality of grooves, at least some of the plurality of grooves having one or more of the plurality of acoustic transducers disposed therein.

3. The loudspeaker of claim 1 wherein each acoustic transducer is configured to emit a first acoustic energy from a first location of the two separated locations along the length of the acoustic transmission line and to emit a second, complementary acoustic energy from a second location of the two separated locations along the length of the acoustic transmission line.

4. The loudspeaker of claim 1 wherein the acoustic transmission line has a closed end and an open end, the acoustic transmission line tapering from the open end to the closed end.

5. The loudspeaker of claim 4 wherein the closed end of the acoustic transmission line tapers to a point.

6. The loudspeaker of claim 4 a cross-sectional diameter of the transmission line at its open end is greater than a cross-sectional diameter of the transmission line at its closed end.

7. The loudspeaker of claim 1 wherein each acoustic transducer is a speaker driver.

8. The loudspeaker of claim 7 wherein each speaker driver includes a diaphragm having a front side and a back side, both sides configured to emit acoustic energy into the acoustic transmission line.

9. The loudspeaker of claim 1 wherein the enclosure, the acoustic transmission line, and the plurality of acoustic transducers are configured to generate an acoustic output having a band-pass characteristic.

10. The loudspeaker of claim 1 wherein the enclosure, the acoustic transmission line, and the plurality of acoustic transducers are configured to have two or more impedance minima.

11. The loudspeaker of claim 1 wherein the enclosure, the acoustic transmission line, and the plurality of acoustic transducers are configured to have two or more motion nulls at frequencies in a pass-band of the acoustic output.

* * * * *